US005233946A

United States Patent [19]

Yamami

[11] Patent Number: 5,233,946

[45] Date of Patent: Aug. 10, 1993

[54] ENGINE-DRIVEN BLOWER UNIT

[75] Inventor: Hirofumi Yamami, Akishima, Japan

[73] Assignee: Kioritz Corporation, Tokyo, Japan

[21] Appl. No.: 926,423

[22] Filed: Aug. 10, 1992

[30] Foreign Application Priority Data

Sep. 19, 1991 [JP] Japan ..... 3-239425

[51] Int. Cl.[5] ..... F01P 7/04

[52] U.S. Cl. ..... 123/41.63; 123/41.65; 15/344; 417/234

[58] Field of Search ..... 123/41.63, 41.65; 15/344; 417/234

[56] References Cited

U.S. PATENT DOCUMENTS

| | | | |
|---|---|---|---|
| Re. 33,050 | 9/1989 | Tuggle et al. | 15/330 |
| 4,318,203 | 3/1982 | Satoh et al. | 15/344 |
| 4,517,939 | 5/1985 | Kiyooka et al. | 123/198 E |
| 4,644,606 | 2/1987 | Luerken et al. | 15/330 |
| 4,723,893 | 2/1988 | Kiyooka et al. | 417/234 |
| 4,792,286 | 12/1988 | Gassen | 417/234 |
| 5,035,586 | 7/1991 | Sadler et al. | 417/363 |

*Primary Examiner*—Noah P. Kamen

*Attorney, Agent, or Firm*—Browdy and Neimark

[57] ABSTRACT

An engine-driven blower unit has a casing, an impeller provided inside the casing, and an engine. The casing has a first opening on its wall close to the cooling fan of the engine so that a portion of the air inside the casing is let out through the first opening toward the engine. A second opening is formed so that a portion of the air around the engine is lead to the inside of the casing, to the downstream of the first opening. Thereby, engine-cooling effect is improved, and operational noise is reduced.

2 Claims, 3 Drawing Sheets

ENGINE-DRIVEN BLOWER UNIT

BACKGROUND OF THE INVENTION

The present invention relates to a blower unit driven by an engine.

An engine, such as an air-cooled two-cycle gasoline engine, is usually operated at its maximum capacity in order to obtain the most power from a rather small-size engine. As a result, a conventional fan connected to a output shaft of such an engine is often found inadequate to sufficiently cool the engine thus operated.

SUMMARY OF THE INVENTION

The present invention is intended to solve the above problem of the conventional art. It is an object of the present invention to provide an engine-driven blower unit which uses a bypass air flow from a blower as a supplement cooling air flow to effectively cool an engine without substantially reducing blower capacity.

According to the present invention, an engine-driven blower unit comprises: a casing; an impeller rotatably provided inside the casing; an engine for driving the impeller; a cooling fan connected to the engine; and an opening formed in a wall of the casing, the wall being close to the cooling fan, so as to lead out a portion of the air inside the casing toward the engine.

Further, according to the present invention, an engine-driven blower unit comprises: a casing; an impeller rotatably provided inside the casing; an engine for driving the impeller; a cooling fan connected to the engine; a first opening formed in a wall of the casing, the wall being close to the cooling fan, so as to lead out a portion of the air inside the casing toward the engine; and a second opening for directing a portion of the air around the engine to the inside of the casing and downstream from the first opening.

Thus, a portion of the air inside the casing is let out through the opening formed in the wall of the casing and effectively helps cool the engine. The air let out of the first opening can be taken into the casing through the second opening.

In an engine-driven blower unit according to the present invention, engine-cooling effect is substantially enhanced without substantially reducing blower capacity, and noise from the blower unit during operation is reduced. Further, a blower unit according to the present invention has a simple construction and can be obtained simply by machine-processing a conventional engine-driven blower unit.

Further objects, features and advantages of the present invention will become apparent from the following description of the preferred embodiments with reference to the attached drawings.

DESCRIPTION OF THE PREFERRED EMBODIMENTS

The present invention will be described hereinafter with reference to the drawings.

Figure 1:
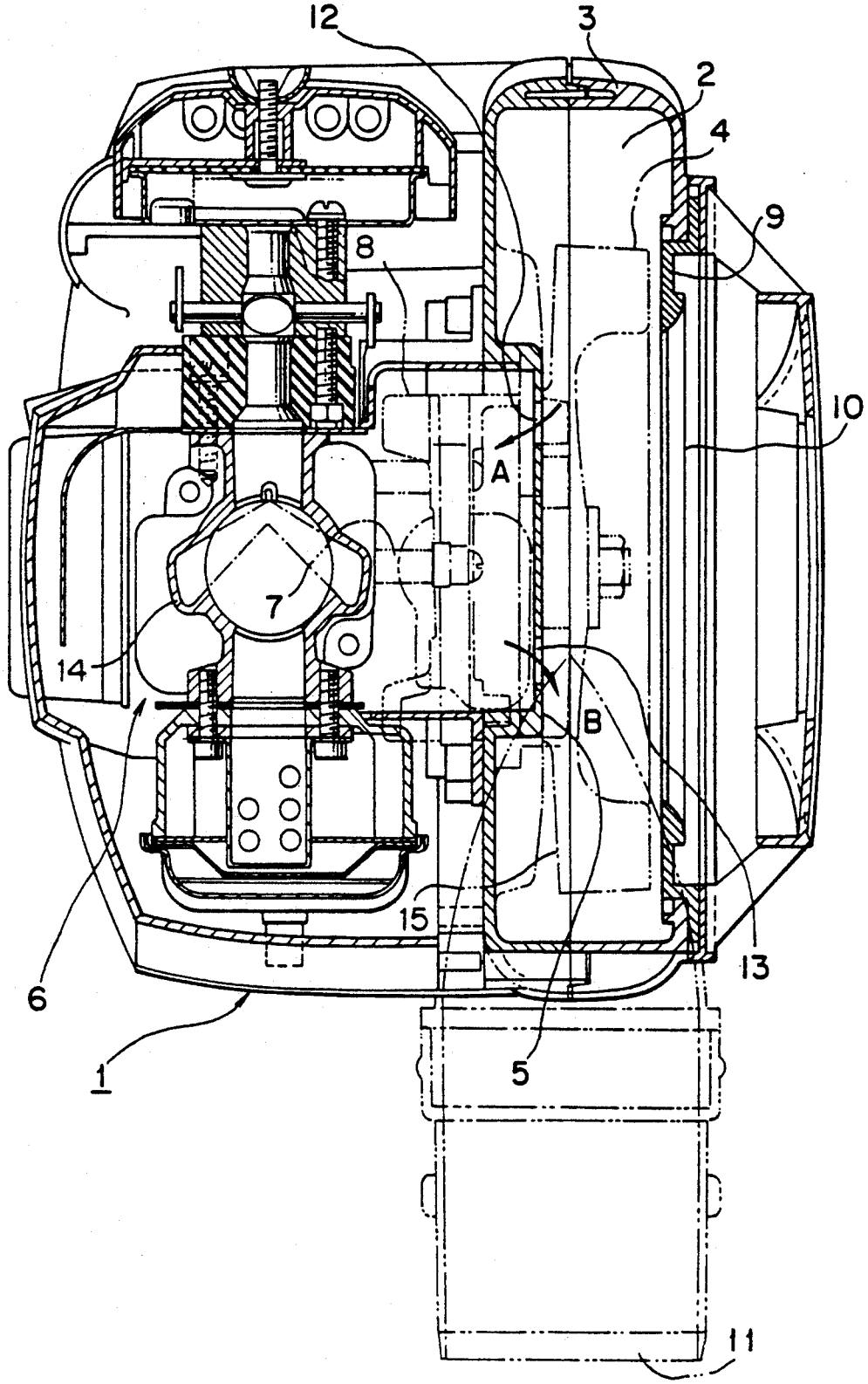
FIG. 1 is a horizontal sectional view of an engine-driven blower unit according to one embodiment of the present invention.
Figure 2:
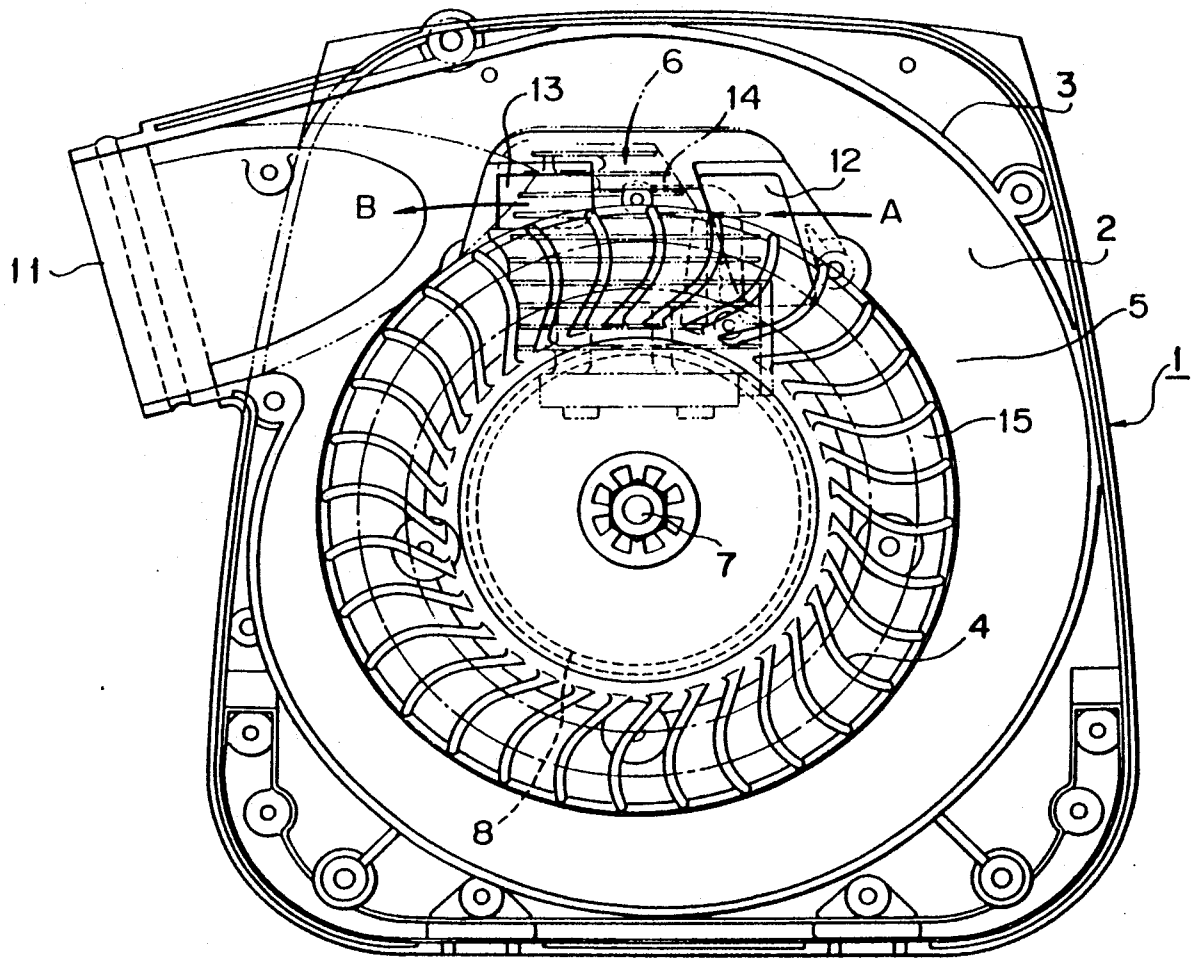
FIG. 2 is the engine-driven blower unit shown in FIG. 1, with a front portion of its casing removed.

Referring to FIGS. 1 and 2, an engine-driven blower unit 1 comprises: a blower unit casing 3 having a volute chamber 2 formed in an inner peripheral portion thereof; an impeller 4 for producing air flow and provided rotatably inside the blower unit casing 3; an engine-cooling fan 8 placed close to a rear wall 5 of the blower unit casing 3; and an engine 6, such as an air-cooled two-cycle gasoline engine. An output shaft 7 of the engine 6 is connected to the impeller 4 provided inside the blower unit casing 3 so as to transmit rotation to the impeller 4. The output shaft 7 of the engine 6 is also connected to the cooling fan 8 so that while the engine 6 is operated, the cooling fan 8 sends air flow to cool the entire body of the engine 6. The blower unit casing 3 has an air inlet 10 in a front wall 9 thereof. During operation, the impeller 4 takes in air from outside through the air inlet 10 and accelerates the taken-in air to send the air to the volute chamber 2. The air sent into the volute chamber 2 is pressured as it is sent through the volute chamber 2, and the pressured air is sent out through a tangential outlet 11 which is formed at an upper portion of the blower unit casing 3. The above-described construction and operation of the engine-driven blower unit 1 are substantially the same as those of a conventional blower unit, and a further description thereof will not be made here.

As a feature of the engine-driven blower unit 1 of the present invention, the rear wall 5 of the blower unit casing 3 has a first opening 12 and a second opening 13 which are formed apart from each other, near the tangential outlet 11, along an air flow passage of the volute chamber 2 and along the outer periphery of the impeller 4. The first and second openings 12 and 13 are close to a cylinder 14 of the engine 6 when the blower unit 1 is assembled. The first opening 12 is farther away from the tangential outlet 11 than is the second opening 13. In other words, the first opening 12 is upstream along the volute chamber 2 from the second opening 13. In this embodiment, the first opening 12 has a comparatively large opening area so as to face not only the volute chamber 2 but also an outer peripheral portion of a base plate 15 of the impeller 4. On the other hand, the second opening 13 has a smaller opening area than the first opening 12 so that a major portion of the second opening 13 faces the volute chamber 2 and the other small portion faces a peripheral portion of the base plate 15 of the impeller 4.

When the engine 6 is operated so that the impeller 4 in the blower unit casing 3 is driven, the cooling fan 8 for the engine 6 blows cooling air to cool the engine 6. A portion of the high pressure air in the volute chamber 2 is led out through the first opening 12, which is formed upstream of the blower unit casing 3 on the rear wall 5, toward the cylinder 14 of the engine 6, as indicated by an arrow A in FIGS. 1 and 2. Thus, the engine 6 is sufficiently cooled by cooling air A from the first opening 12 as well as cooling air from the cooling fan 8. A portion of the air which has received heat from the engine 6 in the neighborhood of the engine 6 is, as indicated by an arrow B in FIGS. 1 and 2, taken into the blower unit casing 3 through the second opening 13, which is formed downstream, and let out through the tangential outlet 11 together with the air coming all the way through the volute chamber 2. The air flow A from the first opening 12 of the blower unit casing 3 provides additional engine-cooling effect. Therefore, the engine 6 can be sufficiently cooled by a combination of the air flow from the cooling fan 8 and the air flow A from the blower unit casing 3. In addition, since the blower unit according to this embodiment comprises two blowers, i.e., the cooling fan 8 and a combination of the impeller 4 and the blower unit casing 3 provided with the first and second openings 12, 13 formed on its rear wall 5, sound wave interference occurs and engine speed decreases, hence the over all noise of the engine-driven blower unit is reduced. These advantages of the present invention were shown by the following performance tests.

Figure 3:
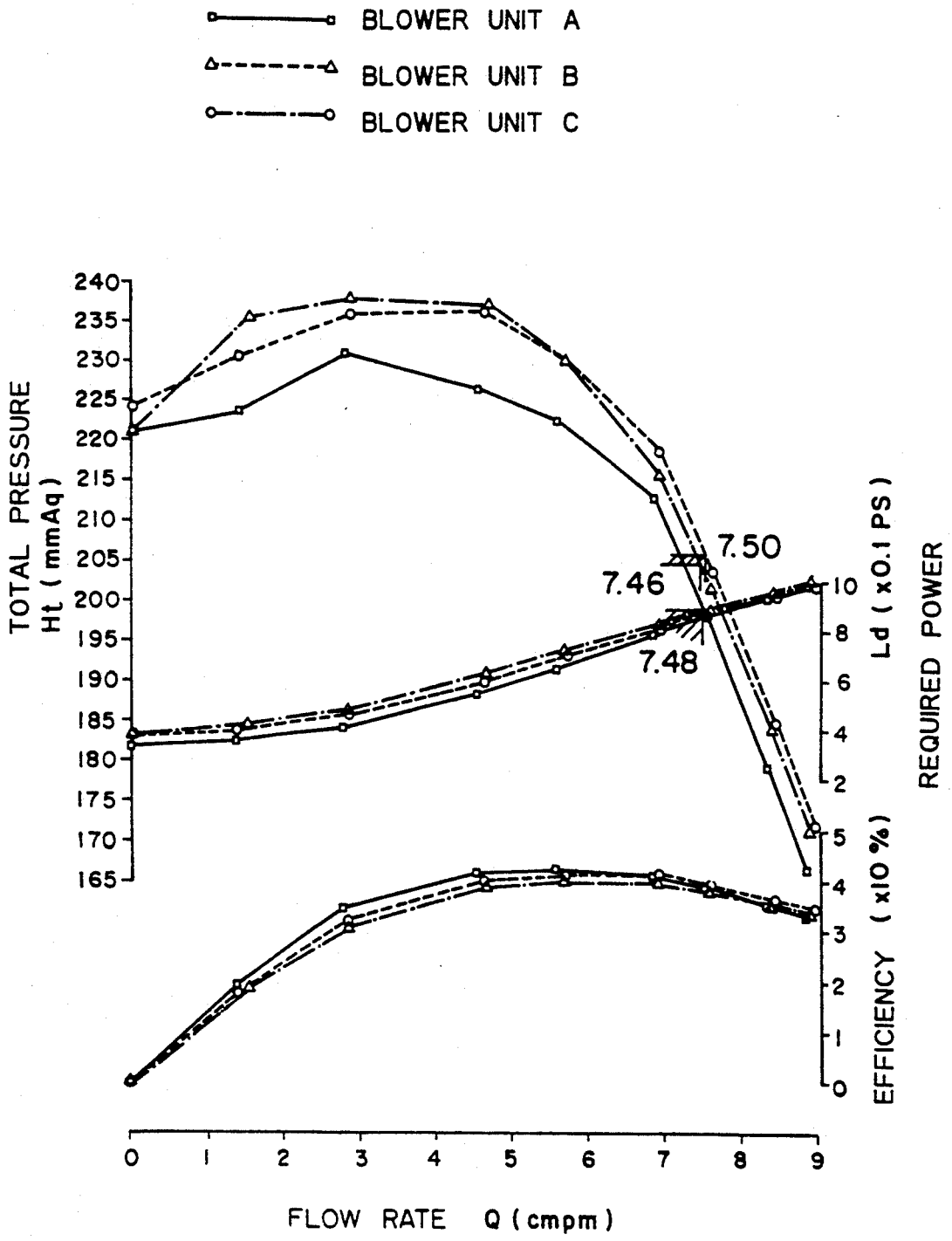
FIG. 3 is a graph showing results of performance tests of the engine-driven blower unit shown in FIGS. 1 and 2.

According to JIS measuring standards, tested were a conventional engine-driven blower unit provided with neither of a first opening 12 nor a second opening 13 (referred to as a "blower unit A" hereinafter), an engine-driven blower unit of the same type as the blower unit A, provided with only a first opening 12 (referred to as a "blower unit B" hereinafter), and an engine-driven blower unit 1 of the same type as the above two blower units A and B, provided with both a first opening 12 and a second opening 13 as shown in FIGS. 1 and 2 (referred to as a "blower unit C" hereinafter). A maximum flow velocity was measured using a Pitot tube and a manometer placed at the outlet of a discharge pipe having a diameter of 58 mm which was connected to the tangential outlet 11 of each blower unit. An average flow rate was calculated from the maximum flow velocity. The rotational speed of electric motors connected with the blower units instead of the engine was set at 7500 rpm. Results are shown in FIG. 3. The average flow rates of the blower units A, B and C were 7.48 $m^3$/min, 7.46 $m^3$/min and 7.56 $m^3$/min, respectively. These blower units were connected to engines 6 and the engines were operated with the engine speed set at 7500 rpm. The temperatures of the spark plug seats of the engines 6 were measured in order to indicate the engine-cooling effects of the blower units. The temperatures of the spark plug seats in the blower units A, B and C were 300° C. or higher, 260° C. and 248° C., respectively. The engine-cooling effect of blower unit A<blower unit B<blower unit C. The actual flow rates of the blower units A, B and C were 8.34 $m^3$/min (at engine speed of 7530 rpm), 8.32 $m^3$/min (at engine speed of 7460 rpm) and 8.27 $m^3$/min (at engine speed of 7420 rpm), respectively.

Noise reduction effect was also tested. The noise level of each of the blower units was measured at eight locations 15 meters apart from the blower unit, and the mean value of the measurements was calculated. The results were 73.0 dB(A) with the blower unit A (at full-throttle engine speed of 7700 rpm and average flow rate of 8.09 $m^3$/min), and 70.1 dB(A) with the blower unit C (at full-throttle engine speed of 7530 rpm and average flow rate of 8.00 $m^3$/min). The results show that, in the blower unit C, the flow rate is substantially the same as that of the blower unit A, the engine speed is somewhat reduced, and the noise is substantially reduced.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. An engine-driven blower unit comprising:

a blower unit casing;

a blower impeller rotatably provided inside said casing;

an internal combustion engine for driving said blower impeller;

a cooling fan connected to said engine; and an opening formed in a rear wall of said casing, said wall being close to said cooling fan, so as to lead out a portion of wind caused by said blower impeller inside said casing toward said engine.

2. An engine-driven blower unit comprising:

a blower unit casing;

a blower impeller rotatably provided inside said blower impeller;

a cooling fan connected to said engine;

a first opening formed in a rear wall of said casing, said wall being close to said cooling fan, so as to lead out a portion of wind caused by said blower impeller inside said casing toward said engine; and a second opening for directing a portion of the air around said engine to the blower impeller inside of said casing and downstream from said first opening.

* * * * *